US010925350B2

(12) United States Patent
Thukkaram

(10) Patent No.: US 10,925,350 B2
(45) Date of Patent: Feb. 23, 2021

(54) NO-TIE SHOELACES

(71) Applicant: Jay Thukkaram, Naperville, IL (US)

(72) Inventor: Jay Thukkaram, Naperville, IL (US)

(73) Assignee: 2nd Strap, LLC, Oak Brook, IL (US)

( * ) Notice: Subject to any disclaimer, the term of this patent is extended or adjusted under 35 U.S.C. 154(b) by 0 days.

(21) Appl. No.: 16/591,060

(22) Filed: Oct. 2, 2019

(65) Prior Publication Data

US 2020/0100570 A1 Apr. 2, 2020

Related U.S. Application Data

(60) Provisional application No. 62/740,240, filed on Oct. 2, 2018.

(51) Int. Cl.

| | |
|---|---|
| ***A43C 7/00*** | (2006.01) |
| ***A43C 1/02*** | (2006.01) |
| ***A43C 9/00*** | (2006.01) |

(52) U.S. Cl.

CPC ..... *A43C 7/00* (2013.01); *A43C 1/02* (2013.01); *A43C 9/00* (2013.01)

(58) Field of Classification Search

CPC ..... A43C 1/02; A43C 7/00; A43C 9/00
See application file for complete search history.

(56) References Cited

U.S. PATENT DOCUMENTS 2,839,804 A * 6/1958 Rafael Benoit ..... A43C 1/02 24/301
3,948,423 A 4/1976 Hathaway
4,790,048 A * 12/1988 Arnt ..... A43C 7/00 24/712.1
5,027,482 A * 7/1991 Torppey ..... A43C 11/1493 36/50.1
5,165,190 A 11/1992 Smyth
5,282,558 A 2/1994 Martinez
5,438,724 A * 8/1995 Merser ..... A43D 11/10 12/113
5,465,442 A * 11/1995 Merser ..... A43D 11/10 12/113
5,572,777 A 11/1996 Shelton
6,026,548 A 2/2000 Jackson
6,138,881 A 10/2000 Paul et al.
6,168,060 B1 1/2001 Mayers
6,220,493 B1 4/2001 Iijima et al.
6,588,079 B1 7/2003 Manzano
6,926,183 B2 8/2005 Chang
7,270,254 B2 9/2007 Kakouras
(Continued)

*Primary Examiner* — Robert Sandy
*Assistant Examiner* — David M Upchurch
(74) *Attorney, Agent, or Firm* — Reinhart Boerner Van Deuren P.C.

(57) ABSTRACT

A shoelace system includes an elastic shoelace having a first end and a second end, and a T-bar attachment attached to the first end. The T-bar attachment is rotatable such that the T-bar attachment anchors the first end of the shoelace to an eyelet of a shoe when the elastic shoelace is pulled through that eyelet. The shoelace system further includes a fastening bracket having one or more openings. Each of the one or more openings has a plurality of inward-facing projections for receiving the second end of the elastic shoelace. The fastening bracket secures the second end of the shoelace in place after the second end is threaded through the one or more openings of the fastening bracket.

19 Claims, 3 Drawing Sheets

(56) References Cited

U.S. PATENT DOCUMENTS

| | | | | |
|---|---|---|---|---|
| 8,231,037 | B2 | 7/2012 | Sacks | |
| D690,505 | S * | 10/2013 | Bird | D3/222 |
| 8,746,523 | B1 | 6/2014 | Woolley | |
| 8,844,780 | B2 | 9/2014 | Hunt | |
| D719,340 | S | 12/2014 | Lee | |
| D719,341 | S | 12/2014 | Lee | |
| D762,459 | S * | 8/2016 | Frydlewski | D8/356 |
| 9,427,045 | B1 * | 8/2016 | Hannon | A43C 1/06 |
| 2020/0085145 | A1 * | 3/2020 | Hamilton | A43C 1/04 |

* cited by examiner

NO-TIE SHOELACES

CROSS-REFERENCE TO RELATED PATENT APPLICATIONS

This patent application claims the benefit of U.S. Provisional Patent Application No. 62/740,240, filed Oct. 2, 2018, the entire teachings and disclosure of which are incorporated herein by reference thereto.

FIELD OF THE INVENTION

This invention generally relates to shoe laces that do not have to be tied or adjusted.

BACKGROUND OF THE INVENTION

People typically tie shoelaces to secure and fit shoes to their feet. The most common means to tie shoes is to use standard shoelace to tie two-loop or "Bunny Ear" method, in the following manner: Step 1: Pulling the separate laces, crossing them and then pulling one lace through a triangular opening while simultaneously pulling on the other lace, Step 2: Forming and maintaining the shape of two "bunny ears" (loops), Step 3: Crossing both loops forming a diamond shape opening, and Step 4: Completing a knot by pulling one.

This method, while common, has several drawbacks. First, knots that are created by using the "Bunny Ear" method can become undone, especially if not tightened properly, and can result in the laces dropping on the floor. This can create a tripping hazard for both the wearer and those around him or her. Second, using standard shoelaces to tie via the "Bunny Ear" method requires the wearer to tie the shoelaces on both feet each time he or she puts the shoes on, and also requires constant adjustment. Furthermore, children and adults, such as those with disabilities or those with arthritis may have relatively poor fine motor skills, and therefore may find it difficult and inconvenient to keep their shoelaces tied.

In view of the foregoing problems, there is a need for a simplified way to secure shoes of all types to the wearer's foot. Both adults and children can greatly benefit from such a device that allows the user to wear any shoe without the need to tie shoelaces and which does not present the risk of the shoelaces becoming untied and creating a tripping hazard.

Embodiments of the present invention provides such a device. These and other advantages of the invention, as well as additional inventive features, will be apparent from the description of the invention provided herein.

BRIEF SUMMARY OF THE INVENTION

In one aspect, embodiments of the invention provide a shoelace system that includes an elastic shoelace having a first end and a second end, and a T-bar attachment attached to the first end. The T-bar attachment is rotatable such that the T-bar attachment anchors the first end of the shoelace to an eyelet of a shoe when the elastic shoelace is pulled through that eyelet. The shoelace system further includes a fastening bracket having one or more openings. Each of the one or more openings has a plurality of inward-facing projections for receiving the second end of the elastic shoelace. The fastening bracket secures the second end of the shoelace in place after the second end is threaded through the one or more openings of the fastening bracket.

In a particular embodiment of the invention, the T-bar attachment and fastening bracket are configured to be positioned on an inside portion of any eyelet such that the T-bar attachment and fastening bracket are not visible on the outside of the shoe after installation.

In certain embodiments, each of the one or more openings is substantially circular and each of the plurality of inward-facing projections points toward a center of its respective opening. In particular embodiments, the number of inward-facing projections ranges from eight to twelve.

In some embodiments, the fastening bracket has only two openings, while, in other embodiments, the fastening bracket has only three openings. Some embodiments of the fastening bracket have only one opening. In a further embodiment, the T-bar attachment has a portion that is at least partially cylindrical and configured to accommodate an end of the shoelace inserted into the at least partially cylindrical portion. The T-bar attachment may have another portion that is at least partially flat.

In certain embodiments, a thickness of the fastening bracket is no more than eight-hundredths of an inch. In other embodiments, a length of the fastening bracket is approximately two-thirds of an inch, and a width of the fastening bracket is approximately one quarter of an inch.

In another aspect, embodiments of the invention provide a shoelace system that includes an elastic shoelace having a first end and a second end, and first and second fastening brackets each with one or more openings. Each of the one or more openings has a plurality of inward-facing projections for receiving the first and second ends of the elastic shoelace. The first and second fastening brackets secure the first and second ends, respectively, of the shoelace in place after the first and second ends are threaded through the one or more openings of its respective fastening bracket.

In certain embodiments, the first and second fastening brackets are configured to be positioned on an inside portion of the eyelet such that the first and second fastening brackets are not visible on the outside of the shoe after installation. In other embodiments, each of the one or more openings in the first and second fastening brackets is substantially circular and each of the plurality of inward-facing projections points toward a center of its respective opening. The number of inward-facing projections may range from eight to twelve.

In some embodiments, the fastening bracket has only two openings, while in other embodiments, the fastening bracket has only three openings. Some embodiments of the fastening bracket have only one opening. In a particular embodiment, a thickness of the fastening bracket is no more than eight-hundredths of an inch. In a further embodiment, a length of the fastening bracket is approximately two-thirds of an inch, and a width of the fastening bracket is approximately one quarter of an inch.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
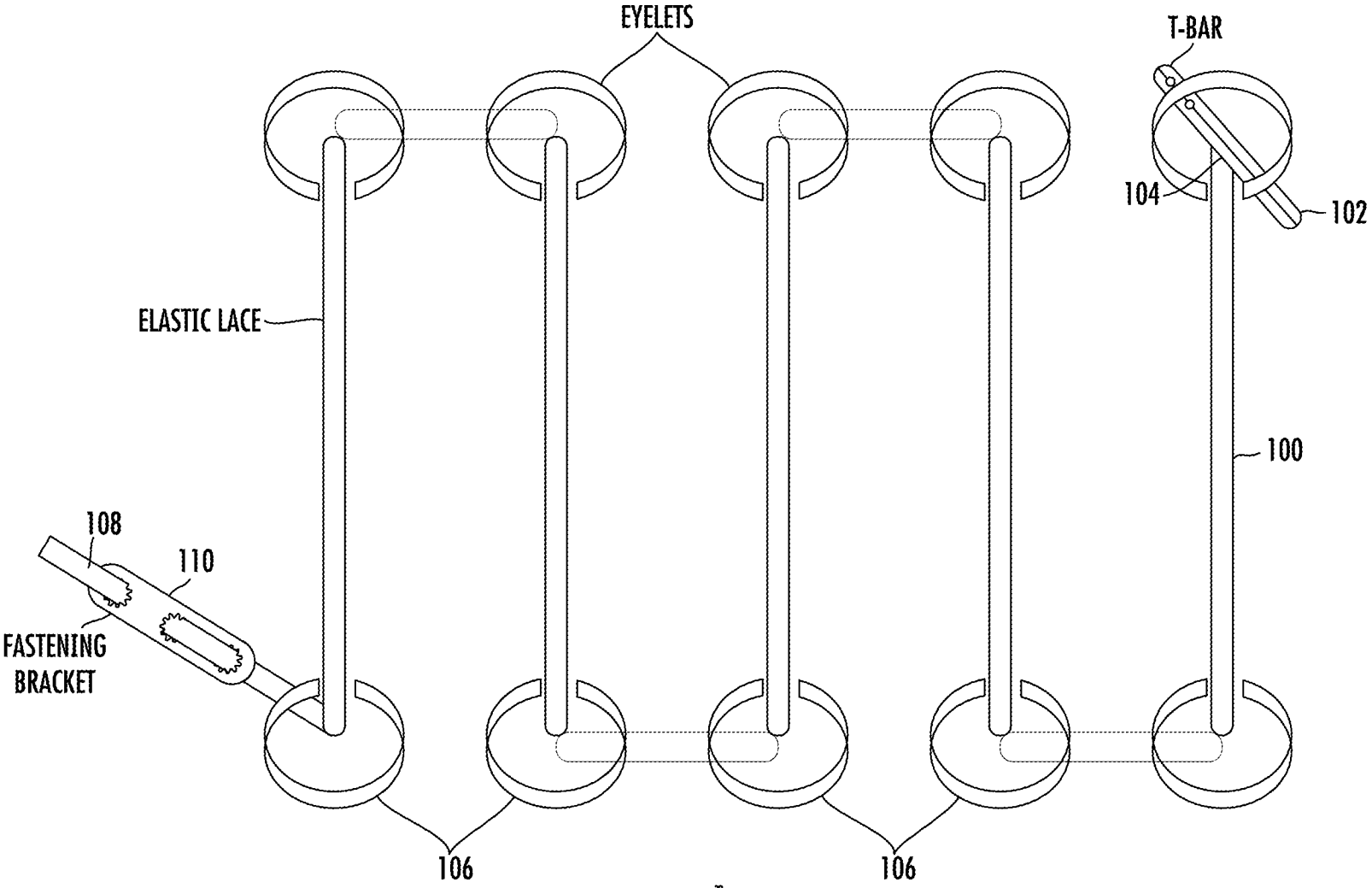
FIG. 1 is a schematic illustration of the shoelace system, in accordance with a particular embodiment of the invention.

The shoelace system disclosed herein is made from only two parts in addition to the laces to make the system simple and easy for the user to install and use. As shown in FIG. 1, the shoelace system includes an elastic shoelace 100 with a T-bar attachment 102 on a first end 104 of the shoelace 100. The T-bar attachment 102 is able to rotate such that the T-bar attachment 102 is essentially perpendicular to the shoelace. Thus, when the shoelace 100 is pulled through an eyelet 106 of a shoe, the T-bar attachment 102 anchors that first end 104 of the shoelace to the aforementioned eyelet 106. The T-bar attachment 102 is normally invisible once installed as it is typically positioned behind the eyelet 106 on the inside of the shoe. In a particular embodiment, the T-bar attachment 102 has a first portion that is at least partially flat, and a second portion that is at least partially cylindrical and configured to accommodate an end of the shoelace 100 inserted into the at least partially cylindrical second portion.

As shown in the schematic drawing of FIG. 1, once the shoelace 100 is threaded through all of the eyelets 106 in the shoe, a second end 108 of the shoelace 100, opposite the first end 104, is secured by a fastening bracket 110 which is used to hold the adjustment/tension of the shoelace 100. Once installed onto the shoe in this manner, the shoelace system does not have to be adjusted or threaded through the eyelets 106 ever again. It should also be pointed out that the lacing pattern is not limited to that shown in FIG. 1. A wide variety of different patterns may be used for lacing a shoe using the system described herein, as long as the first and second ends 104, 108 of the shoelace 100 are properly anchored by some combination of fastening brackets 110 and/or T-bar attachment 102.

Figure 2:
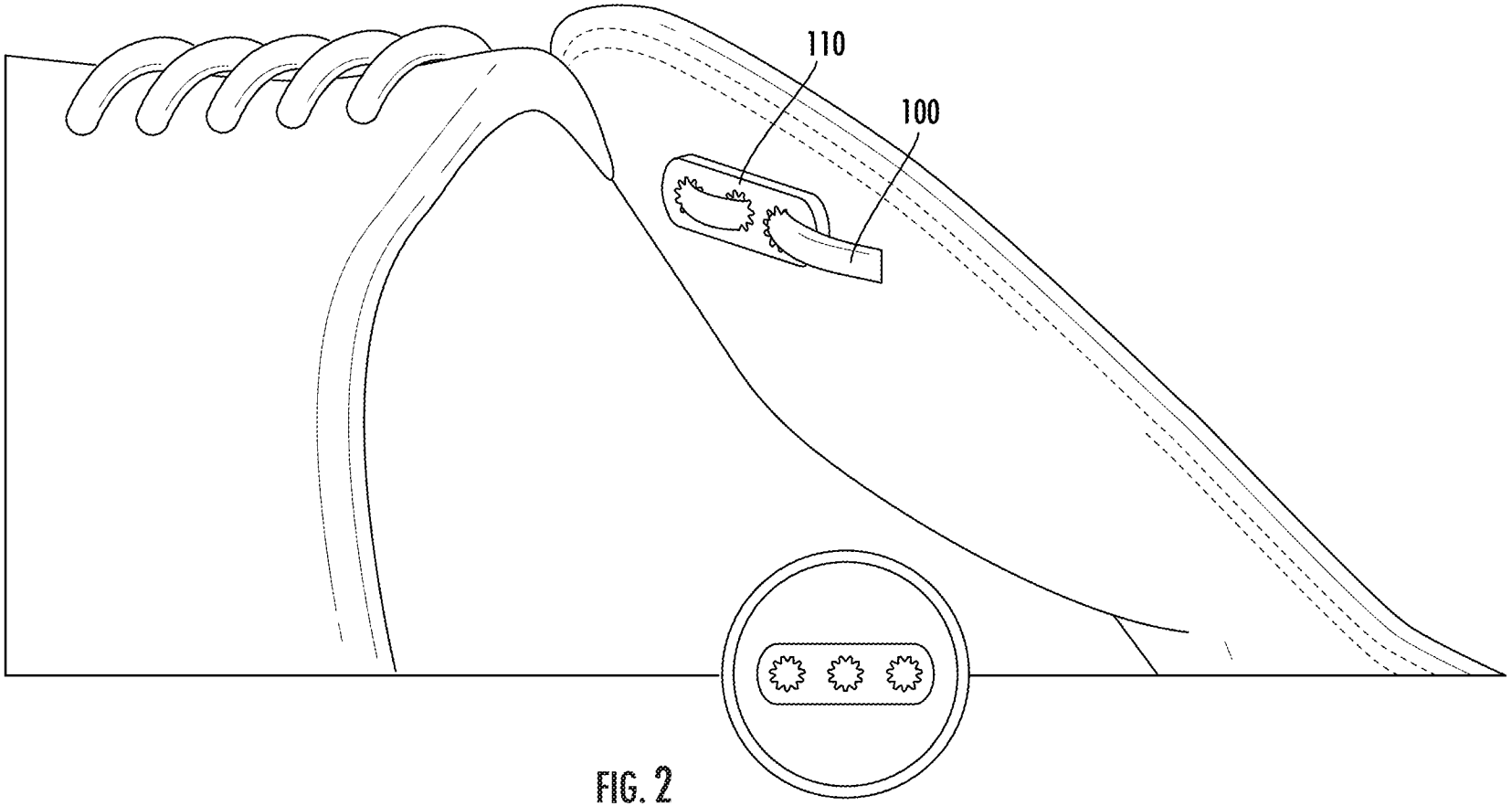
FIG. 2 is a perspective view of a shoe with the fastening bracket installed behind an eyelet of the shoe, according to an embodiment of the invention.
Figure 3:
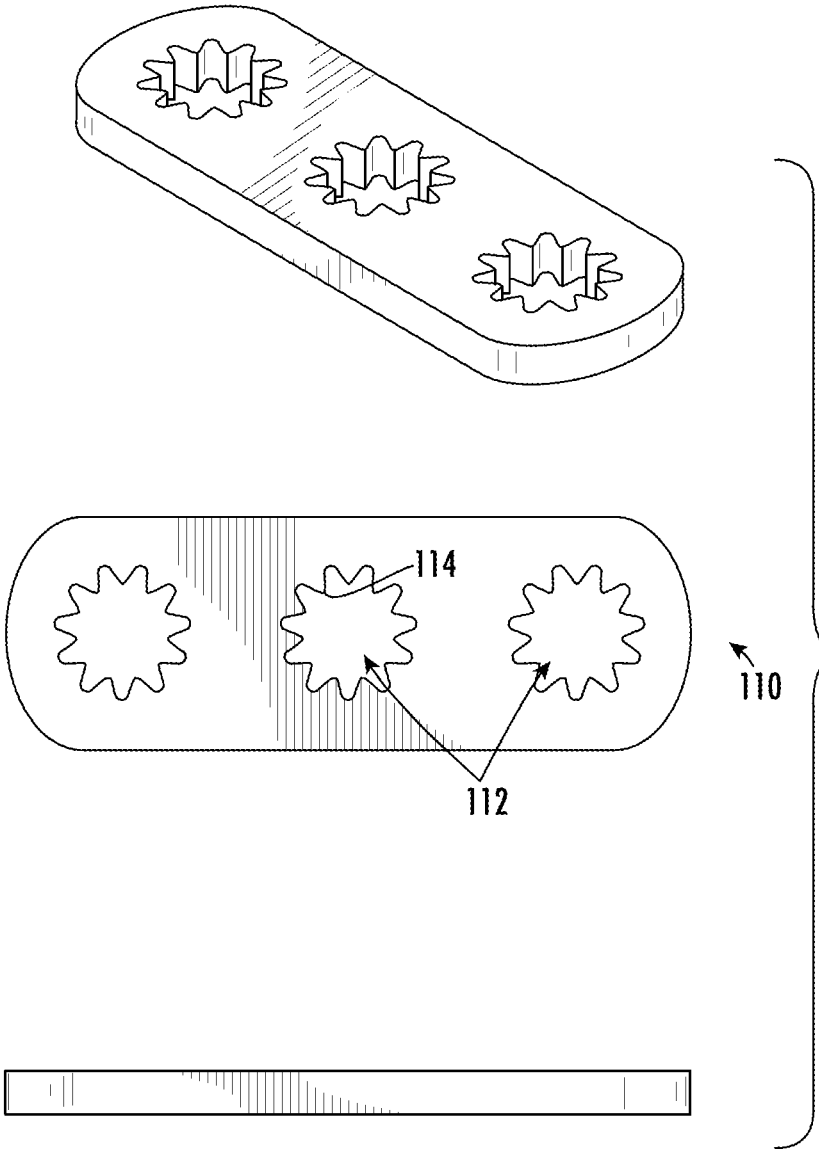
FIG. 3 shows a top view of the fastening bracket, according to an embodiment of the invention.

FIGS. 2 and 3 provide an exemplary embodiment of the fastening bracket 110. In the embodiment shown in FIG. 3, the fastening bracket 110 includes a flat plate-like body with three openings 112, where each of the openings 112 has a plurality of inward-facing projections 114. It is envisioned that other embodiments of the fastening bracket 110 may have fewer or more than three openings 112. Fastening brackets 110 with two openings 112 or even one opening are envisioned. The plurality of inward-facing projections 114 effectively secures the second end 108 of the shoelace 100 in place after the second end 108 is threaded through the three openings 112. In the embodiment of FIG. 3, there are 11 inward-facing projections 114 in each of the three openings 112 of the fastening bracket 110. However, in alternate embodiments, the number of inward-facing projections 114 may range from eight to 12.

More specifically, the fastening bracket 110 holds the second end 108 of the shoelace 100 in place at the last eyelet 106 of the shoe to be threaded, and prevents the shoelace 100 from coming out of this last eyelet 106. In this manner, the shoelace 100 is permanently held in place at the length desired by the user to allow for a secure fit and easy removal of the shoe. Like the T-bar attachment 102, the fastening bracket 110 is normally invisible once installed as it is typically positioned behind the eyelet 106 on the inside of the shoe, as illustrated in FIG. 2.

Once the second end 108 of the shoelace 100 is threaded through the openings 112 of the fastening bracket 110, any remaining, unneeded portion of the shoelace 100 can be cut off and thrown away. It is envisioned that the T-bar attachment 102 and the fastening bracket 110 can be made of metal or plastic, though other suitably similar materials may be used.

In a particular embodiment of the invention, the thickness of the fastening bracket 110 is approximately five-hundredths of an inch. In a particular embodiment, the thickness of the fastening bracket 110 is no more than eight-hundredths of an inch. In this embodiment, the length of the fastening bracket 110 ranges from two-thirds of an inch to one inch, while the width is approximately one quarter of an inch. It should be noted that the term "approximately", as used herein, means within plus or minus 20% of the nominal value.

The shoelace system of the present invention is made to look indistinguishable from conventional shoelaces, and the system is constructed to work well in virtually any type of shoe. However, the shoelace system of the present invention only needs to be installed onto the shoe one time.

The shoelace system disclosed herein will work on shoes with virtually any number of eyelets 106, though ideally, the system works best when the shoe has at least three pairs of eyelets 106. Even and odd numbered pairs of eyelets 106 will both work equally well, though the length of the elastic shoelace 100 may have to be adjusted depending on the number of eyelets 106. Once the shoelace system is installed onto the shoe, the elastic shoelace 100 makes it possible for the user to quickly and easily take the shoe on or off as needed without adjustment, re-fastening, or re-tying of the shoelace 100.

Additionally, as can be seen from FIG. 3 and as explained above, the shoelace system disclosed herein is designed to be invisible once installed. That is, the T-bar attachment 102 and fastening bracket 110 are typically positioned on the inside portion of the eyelets 106 so that the only visible portion of the shoelace system is the elastic laces 100. This allows for a pleasing visual appearance that will appeal to users of the shoelace system.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A shoelace system comprising:

an elastic shoelace having a first end and a second end;

a T-bar attachment attached to the first end, wherein the T-bar attachment is rotatable such that the T-bar attachment anchors the first end of the shoelace to an eyelet of a shoe when the elastic shoelace is pulled through that eyelet;

a fastening bracket having one or more openings, wherein each of the one or more openings has a plurality of inward-facing projections for receiving the second end of the elastic shoelace, wherein the fastening bracket secures the second end of the shoelace in place after the second end is threaded through the one or more openings of the fastening bracket.

2. The shoelace system of claim 1, wherein the T-bar attachment and fastening bracket are configured to be positioned on an inside portion of the eyelet such that the T-bar attachment and fastening bracket are not visible outside of the shoe after installation.

3. The shoelace system of claim 1, wherein each of the one or more openings is substantially circular and each of the plurality of inward-facing projections points toward a center of the opening in which the inward-facing projection resides.

4. The shoelace system of claim 1, wherein the plurality of inward-facing projections ranges from eight to twelve in number.

5. The shoelace system of claim 1, wherein the fastening bracket has only two openings.

6. The shoelace system of claim 1, wherein the fastening bracket has only three openings.

7. The shoelace system of claim 1, wherein the T-bar attachment has a portion that is at least partially cylindrical and configured to accommodate an end of the shoelace inserted into the at least partially cylindrical portion.

8. The shoelace system of claim 7, wherein the T-bar attachment has another portion that is at least partially flat.

9. The shoelace system of claim 1, wherein a thickness of the fastening bracket is no more than eight-hundredths of an inch.

10. The shoelace system of claim 1, wherein a length of the fastening bracket is approximately two-thirds of an inch, and a width of the fastening bracket is approximately one quarter of an inch.

11. The shoelace system of claim 1, wherein the fastening bracket has only one opening.

12. A shoelace system comprising:

an elastic shoelace having a first end and a second end;

first and second fastening brackets each with one or more openings, wherein each of the one or more openings has a plurality of inward-facing projections for receiving the first and second ends of the elastic shoelace, wherein the first and second fastening brackets secure the first and second ends, respectively, of the shoelace in place after the first end is threaded through the one or more openings of the first fastening bracket and after the second end is threaded through the one or more openings of the second fastening bracket;

wherein the first and second fastening brackets are configured to be positioned on an inside portion of a shoe such that the first and second fastening brackets are not visible on the outside of the shoe on which the shoelace system is installed.

13. The shoelace system of claim 12, wherein each of the one or more openings in the first and second fastening brackets is substantially circular and each of the plurality of inward-facing projections points toward a center of the opening in which the inward-facing projection resides.

14. The shoelace system of claim 12, wherein the plurality of inward-facing projections ranges from eight to twelve in number.

15. The shoelace system of claim 12, wherein the fastening bracket has only two openings.

16. The shoelace system of claim 12, wherein the fastening bracket has only three openings.

17. The shoelace system of claim 12, wherein the fastening bracket has only one opening.

18. The shoelace system of claim 12, wherein a thickness of the fastening bracket is no more than eight-hundredths of an inch.

19. The shoelace system of claim 12, wherein a length of the fastening bracket is approximately two-thirds of an inch, and a width of the fastening bracket is approximately one quarter of an inch.

* * * * *